US007017319B2

(12) United States Patent
Bowman

(10) Patent No.: US 7,017,319 B2
(45) Date of Patent: Mar. 28, 2006

(54) METHOD AND SYSTEM FOR FINISHING OPENINGS FOR WINDOWS AND OTHER FRAMED INSERTS

(76) Inventor: Kenneth Peter Bowman, P.O. Box 13371, Mill Creek, WA (US) 98082

( * ) Notice: Subject to any disclaimer, the term of this patent is extended or adjusted under 35 U.S.C. 154(b) by 78 days.

(21) Appl. No.: 10/661,795

(22) Filed: Sep. 12, 2003

(65) Prior Publication Data

US 2005/0055965 A1 Mar. 17, 2005

(51) Int. Cl.
*E04C 3/30* (2006.01)

(52) U.S. Cl. ..... 52/734.2; 52/745.15; 52/204.1

(58) Field of Classification Search ..... 52/745.15, 52/745.16, 742.13, 204.1, 204.7, 209, 734.2
See application file for complete search history.

(56) References Cited

U.S. PATENT DOCUMENTS 2,697,932 A * 12/1954 Goodwin ..... 52/97
2,800,956 A * 7/1957 Xanten ..... 160/91
3,323,262 A * 6/1967 Cesare Jr. et al. ..... 52/204.54
3,375,627 A * 4/1968 Bursiek et al. ..... 52/213
4,341,831 A * 7/1982 Kleiss ..... 428/188
4,492,062 A * 1/1985 Levenez ..... 52/97
4,787,131 A * 11/1988 Pacca ..... 29/401.1
4,831,804 A * 5/1989 Sayer ..... 52/475.1
5,746,033 A * 5/1998 Chuang ..... 52/213
5,802,785 A * 9/1998 Crook ..... 52/204.53
6,055,782 A * 5/2000 Morton et al. ..... 52/204.1

* cited by examiner

*Primary Examiner*—Basil Katcheves

(57) ABSTRACT

A method and system for finishing windows uses a shim plate. The shim plate is fastened to a framing member and extends between the framing member and the periphery of the framed insert. Foaming material is expanded between the sill plate and the framing member to support the shim plate relative to the framing member. Finishing material may be placed against the shim plate and fastened in place to finish the window opening.

7 Claims, 4 Drawing Sheets

METHOD AND SYSTEM FOR FINISHING OPENINGS FOR WINDOWS AND OTHER FRAMED INSERTS

FIELD OF THE INVENTION

The present invention relates to the field of building construction and more particularly to the field of finishing openings for doors, windows and the like.

BACKGROUND OF THE INVENTION

Window and door installation continues to be a time-consuming and labor intensive process. The prior art process can be most easily described in connection with wood frame structures, but the process remains similar for many other types of structures.

In a wood frame structure, the opening for the framed member, such as a window or door is first rough framed, with the framing members serving as the mounting members for windows and doors. The interior wall finishing for a room, such as wallboard, is usually affixed to the framing to form the interior wall of the room, and portions of wallboard may be used to finish the opening as well.

As shown in FIG. 1, which is labeled as prior art, window frames 10 typically have a flange 12, an interior face 14, a base 16 and other elements for supporting windows and screens. Apertures 18 are provided in the flange 12 for fastening the window in place. For purposes of this discussion, the base 16 of the top, bottom and side portions forming the frame of the window define the periphery of the window.

Typically, a window opening will be 1.3 cm (½ inches) larger on all sides than the frame of the window to be installed (excluding the flange 12 and other portions that depend from the base 16). The window is then set into the window opening, and paper or wood shims are inserted along the top, sides and bottom of the window frame to level and center it. The window frame is then fastened in place using screws or nails, and is caulked to seal against intrusion of wind and water. Materials such as wall board (gypsum board), wood and the like are then applied to the interior of the window opening and are butted up against the window frame to form the finished window opening.

Framing inaccuracies, bowing, twist or other defects in the framing of the window opening and the like can result in irregularities in the spacing between the interior of the window opening and the window frame. For example, if the window opening is in the configuration of a parallelogram, one side of the window frame may be nearly abutting the interior of the window opening at the bottom, and the other side of the window opening may be nearly abutting the frame at its top. In such case, the finishers installing the wall board or the like around the window opening may have to take time-consuming and labor-intensive remedial measures to ensure that the gypsum board or the like is squared and uniformly spaced with respect to the window frame and window.

Installation of pre-hung doors typically proceeds in like manner to window installation and encounters the same problems.

It is known to use an L-shaped shim plate to facilitate the finishing of the window opening. The first part of the shim plate extends into the window opening, and the second part of the shim plate lies in the plane of the wall. According to the known method, a plurality of nails or screws are partially sunk into the wood forming the window opening in a direction parallel to the plane of the window and extend generally perpendicular to the surface of the framing members that form the window opening. The heads of the nails or screws are left protruding inwardly into the window opening and form supports for the first portion of the sill plate.

The second portion of the sill plate, the securing flange, is then nailed in place to the side of the framing members forming the interior of the room. The wallboard, wood or other finishing materials are then positioned in contact with the first portion of the sill plate.

The process of setting the nails or screws to support the sill plate is time consuming and prone to errors. If the heads of the screws or nails are not set precisely, the sill plate will not be supported along its length at the proper position relative to the window. Furthermore, when the wallboard, wood or other finishing materials are nailed in place, and the nails are driven through the sill plate, the sill plate may be distorted and cause the finishing material to be improperly positioned.

BRIEF DESCRIPTION OF THE INVENTION

In one aspect, the present invention provides a method and system for compensating for irregularities in the window opening. The method may use a shim plate at the top, bottom and sides of a window that has been set in a window opening. One surface of the shim plate may be squared with and may bear inwardly toward the center of the window against the periphery of the window frame, or may be inserted into a slot formed by the window frame. In another aspect, expanding foam may be used between the framing of the window opening and the shim plate to support it and seal against air leakage around the frame.

In another aspect, wall board may be placed in contact with the shim plate and fastened in place by nails or screws extending through the shim plate. In another aspect, the shim plate may be made of a strip of metal such as galvanized steel sheet that is bent along its length at a right angle. In another aspect, the shim plate may be made of plastic or composite material.

DETAILED DESCRIPTION OF EMBODIMENTS OF THE INVENTION

The present invention provides a method and apparatus for finishing windows and doors. The resulting window opening may be level and plum in relation to the window. That is, the finishing panels may be square to one another and perpendicular to the plane of the window or door. As the processes for installation of windows and doors are analogous, the present invention will be described with reference to windows.

Figure 1:
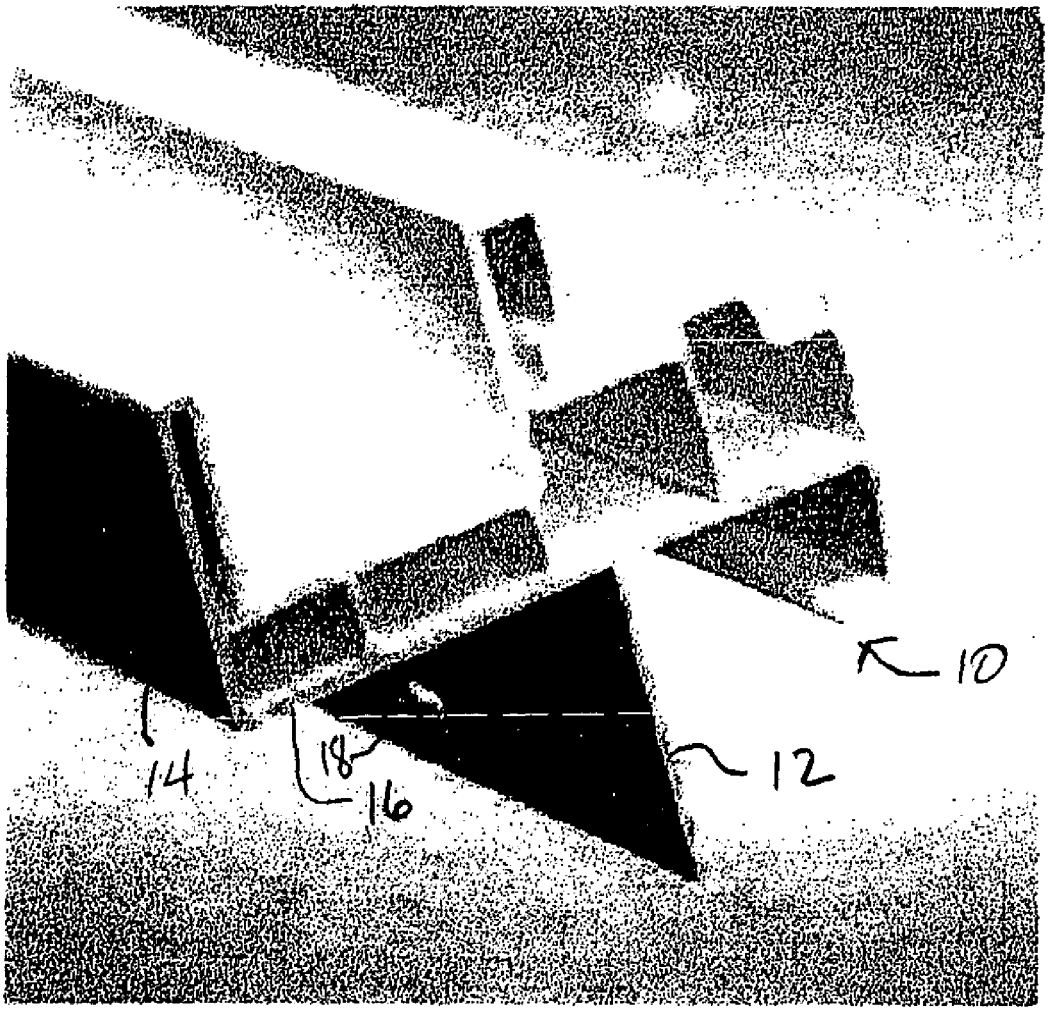
Prior Art Fig. 1
FIG. 1 is a perspective view of a portion of a prior art window frame.
Figure 2:
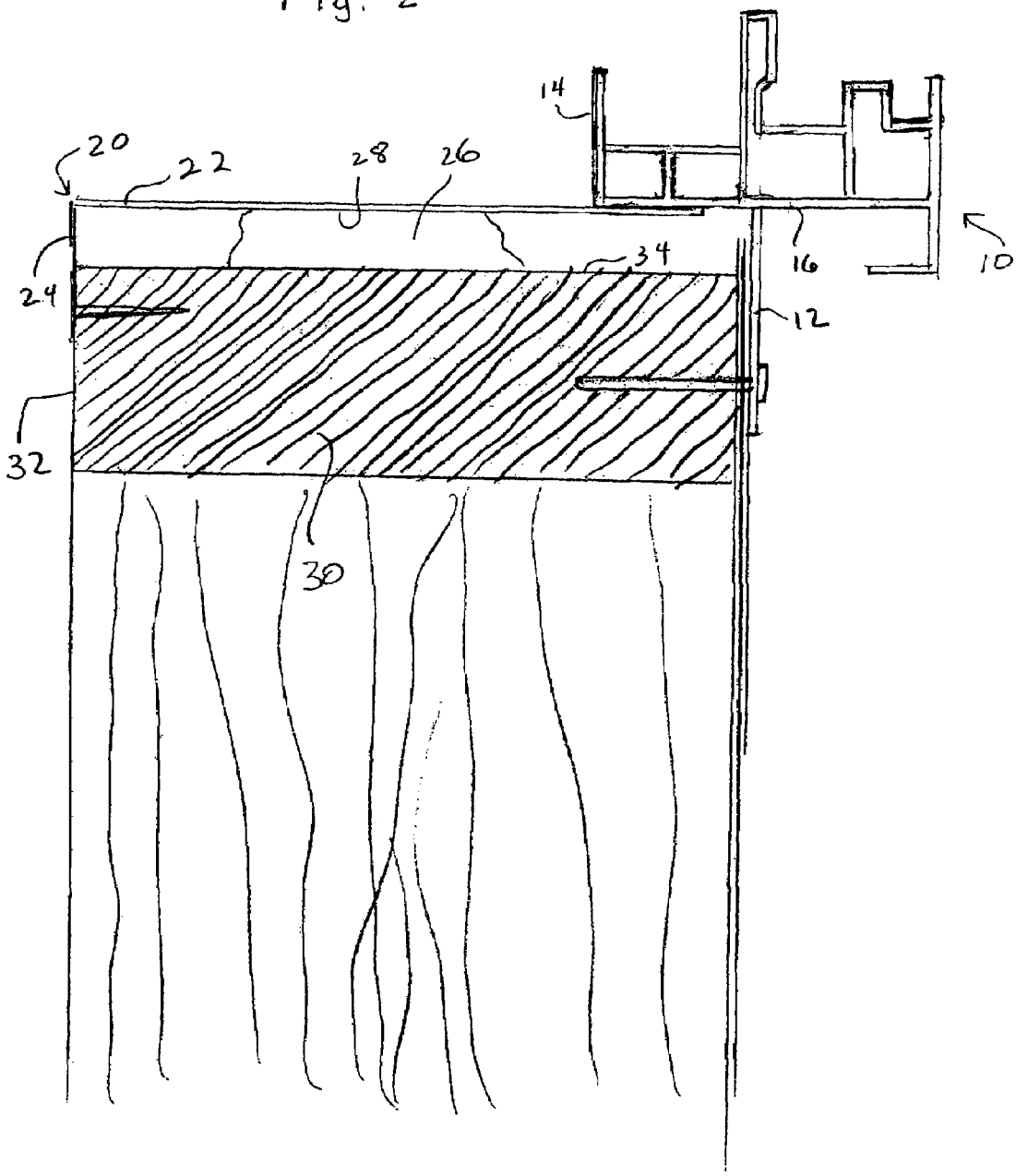
FIG. 2 is a cross-sectional view of a shim plate with portions of the framing and of a window frame shown.
Figure 4:
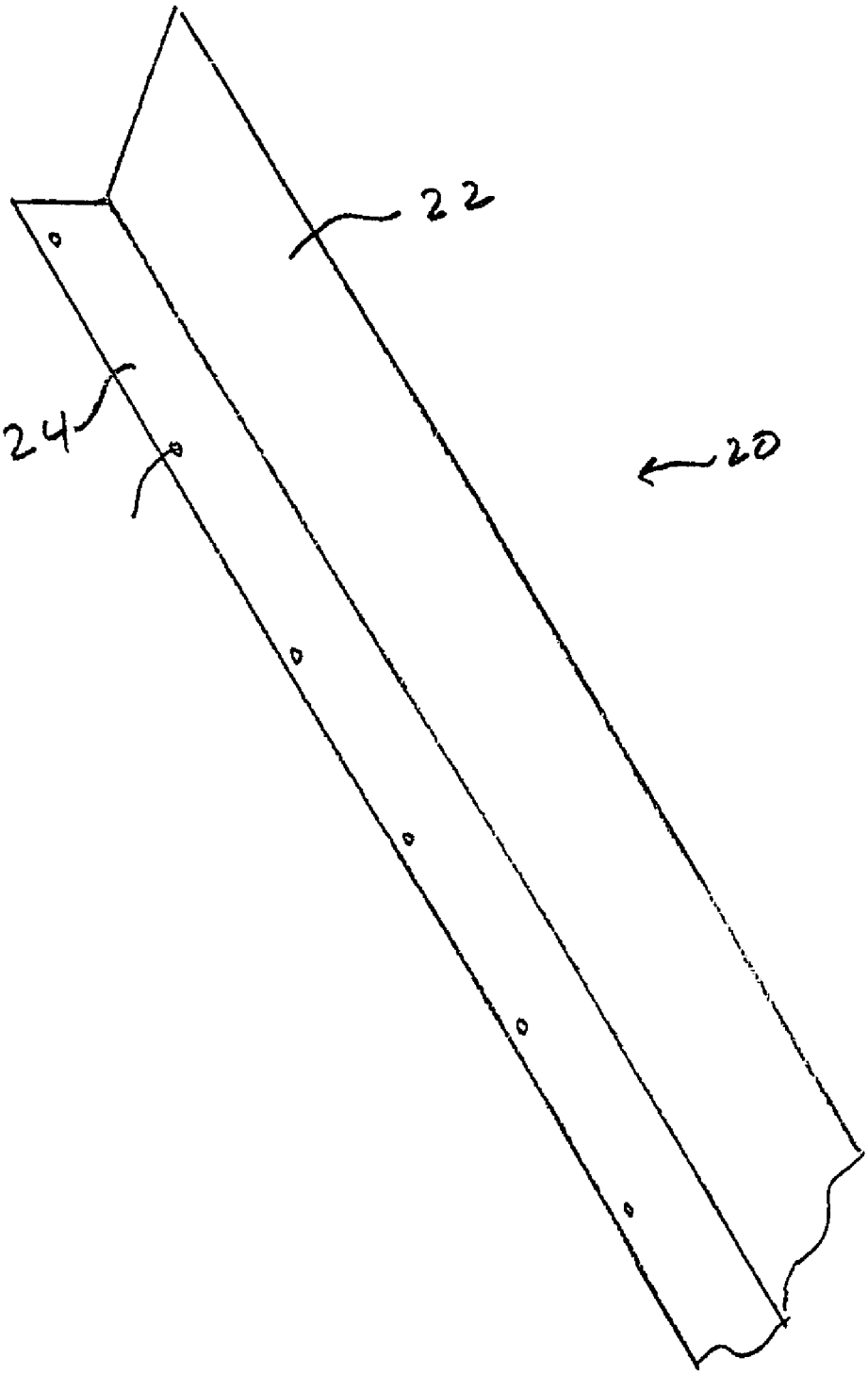
FIG. 4 is a perspective view of a shim plate.

As shown in FIG. 2, the window opening may be conformed to the window frame by use of a shim plate 20. The shim plate may be made of metal, such as 24 gauge galvanized steel, or of a plastic or composite material. Referring to FIGS. 2 and 4, the shim plate of the present embodiment comprises a sill portion 22 and a fastening flange 24. The width of the shim plate 20 is sufficient to extend from the interior edge 32 of the framing member to a position beneath the base 16 of the frame of the window 10.

According to one embodiment, the shim plate 20 may be used by positioning it with its distal end under the base 16 of the window frame 10. The shim plate 20 is then leveled and fastened in place, on the interior surface 32 of the associated framing member 30 as by nails or screws.

In order to support the sill portion 22 of the shim plate 20 so that nails may be driven through it, an expanding foam 26 may be used between the lower surface 28 of the sill portion 22 of the shim plate 20 and the upper surface 34 of the framing member 30. The foam may be applied to the upper surface 34 of the framing member 30 (or to the lower surface 28 of the sill portion 22 of the shim plate 20) before the shim plate 20 is positioned and fastened in place. Alternatively, apertures (not shown) could be provided along the length of the sill portion 22 or fastening flange 24 of the shim plate 20, and the foam could be injected under the shim plate 20.

Various types of foams may be used. For example, a low-expansion insulating foam, such as the Great Stuff brand foam provided by the Dow Chemical Company or other insulating and/or sealant foams, or a two-part urethane foam may be used. If the foam 26 is to be applied before installation of the shim plate 20, the foam 26 may have an expansion rate that is sufficiently slow that a skilled worker can install the shim plate 20 before the foam has completed its expansion. In such case, excess foam may be expelled around the ends of the shim plate 20, or even through apertures (not shown) that may be provided for such purpose in the shim plate 20. Any such excess foam may be cut or scraped away to remove it. The foam 26 may fill or substantially fill the space between the framing member 30 and the shim plate 20. To the extent that the foam fills this space, of course, it may also constitute a barrier against intrusion of the elements and may also provide thermal insulation.

Figure 3:
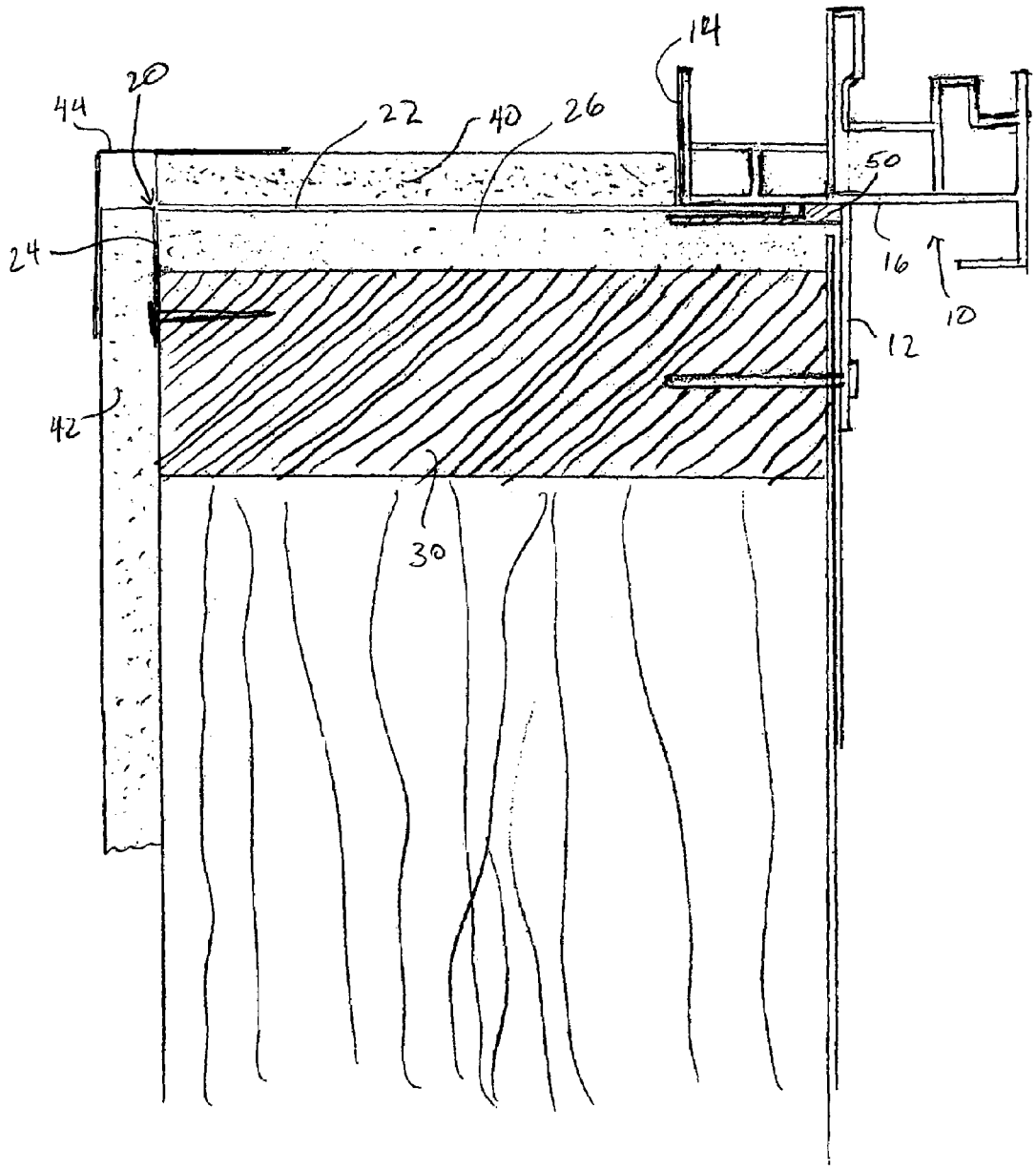
FIG. 3 is a cross-sectional view of a shim plate with portions of the framing and of a window frame shown and with finishing material installed.

Referring to FIG. 3, with the shim plate in place and the foam 26 expanded, the shim plate 20 is urged upward into contact with the base 16 of the window frame 10. In one embodiment, the sill portion 22 of the shim plate 20 is supported sufficiently by the fastening of the fastening flange 24 to the framing member 30 and by the foam expanded between the framing member 30 and the shim plate 20 that nails may now be extended through the sill portion 22 of the shim plate 20.

Accordingly, the window may be finished by positioning pieces of wallboard, wood or other finishing materials, such as the strip of wallboard 40, on top of the shim plate 20 and fastening it to the framing member 30 with nails or the like. In such case, the sill portion 22 of the shim plate 20 will be supported against the force used to drive the nails by the foam 26 and by the nails securing the fastening flange 24 to the framing member 30. Wallboard 42 or other finishing materials may also be affixed to the interior surface of the structure, overlapping the fastening flange 24 of the shim plate 20. A corner bead 44 may then be applied over the strip of wallboard 40 and the wallboard 42. The sides and top of the window opening can be regularized in like manner using shim plates 20, foam 26, and so forth to provide a finished window opening that is square and plumb. As such, drapes, curtain rods, wall paper seams and the like can all be square to the finished window opening despite framing errors or twists in or bowing of the framing members.

In another embodiment, as shown in FIG. 3, the window frame includes a lip 50 which may be connected to one or both of the base 16 and flange 12 of the window frame 10, and which extends inwardly toward the plane of the interior face 14 of the frame 10. The lip 50 is spaced from the base a sufficient distance to permit the shim plate 20 to be inserted into the slot formed between the lip 50 and the base 16. The lip 50 and base 16 thus cooperate to restrict the distal edge of the sill portion 22 of the shim plate 20 from upward or downward motion relative to the frame 10 and framing member 30. Foam may still be inserted between the framing member 30 and shim plate 20 to provide support, weather sealing and insulation.

In other embodiments, the sill portion 22 of the shim plate may be partially perforated or scored along a line inwardly of its distal edge. The strip between the perforations or scoring and the distal edge of the shim plate 20 may be cut or broken off to accommodate different depths of the window opening. For example, framing members may be of different widths, such as nominal four or six inches. Removing the section of the sill portion 22 outward of the perforations or scoring might yield a shim plate 20 appropriate for a nominal four inch window opening, whereas the shim plate 20 in its original dimensions could be used for a window framed with nominal six inch framing members.

The invention has been described with respect to wood framed structures. However, it may be adapted to other types of structures. The present invention has also been described with reference to various embodiments thereof. It will be appreciated by those skilled in the art that various modifications and changes of configuration may be made, all within the scope of the invention. Accordingly, the scope of the invention should be interpreted according to the appended claims.

What is claimed is:

1. A method of finishing openings for framed inserts comprising the steps of:

inserting a shim plate between a framing member and the periphery of a framed insert, the shim plate having a sill portion and a fastening flange;

affixing the fastening flange of the shim plate to the interior surface of the framing member such that the distal edge of the sill portion that extends between the periphery of the framed insert and the framing member is in close proximity to the periphery of the framed insert;

expanding a foaming material between the framing member and the shim plate supporting the shim plate relative to the framing member;

positioning finishing material on top of the sill portion of the shim plate and fastening the finishing material to the framing member using fasteners extended through the shim plate and foaming material into the framing member.

2. The method of claim 1 wherein the distal edge of the sill portion of the shim plate is inserted into a slot formed between the periphery of the framed member and a lip extending inwardly from the frame of the framed member for supporting the distal edge of the sill portion of the shim plate against deflection toward the frame member.

3. The method of claim 1 wherein the shim plate is formed of sheet steel bent into an L-shaped form.

4. The method of claim 1 wherein the shim plate is formed of a plastic material.

5. The method of claim 1 wherein the foaming material is a low-expansion foaming material.

6. The method of claim 1 wherein, prior to the step of affixing the fastening flange to the framing member the sill portion of the shim plate is oriented in a plane perpendicular to the plane of the framed insert with the distal edge of the shim plate in contact with the periphery of the framed member.

7. A system comprising a shim plate, a foaming material and at least one frame member forming a framed opening for a framed insert comprising:

an L-shaped shim plate fastened to a the at least one framing member of an opening for a framed insert, the shim plate having a sill portion and a fastening flange, the sill portion of the shim plate being of sufficient width that, when the fastening flange is attached to the interior of the framing member, the sill portion extends between the periphery of the framed insert and the framing member; and a foaming material expanded between the framing member and the shim plate and supporting the shim plate relative to the framing member as fasteners are extended through the shim plate and expanded foaming material into the framing member.

* * * * *